US012145023B2

(12) United States Patent
Wang et al.

(10) Patent No.: US 12,145,023 B2
(45) Date of Patent: Nov. 19, 2024

(54) MOTOR BRAKE DEVICE FOR EXERCISE APPARATUS

(71) Applicant: Johnson Health Tech. Co., Ltd., Taichung (TW)

(72) Inventors: Yung-Fa Wang, Taichung (TW); Mei-Yi Wu, Changhua (TW)

(73) Assignee: Johnson Health Tech Co., Ltd., Taichung (TW)

( * ) Notice: Subject to any disclaimer, the term of this patent is extended or adjusted under 35 U.S.C. 154(b) by 0 days.

(21) Appl. No.: 18/402,681

(22) Filed: Jan. 2, 2024

(65) Prior Publication Data

US 2024/0139581 A1 May 2, 2024

Related U.S. Application Data

(63) Continuation of application No. 17/537,493, filed on Nov. 30, 2021, now Pat. No. 11,944,864.

(30) Foreign Application Priority Data

Dec. 8, 2020 (CN) ..... 202022920483.0

(51) Int. Cl.
*A63B 22/02* (2006.01)
*A63B 23/035* (2006.01)

(52) U.S. Cl.
CPC ..... *A63B 22/0235* (2013.01); *A63B 23/035* (2013.01); *A63B 2220/833* (2013.01)

(58) Field of Classification Search
CPC ..... A63B 22/0235; A63B 23/035; A63B 2220/833; A63B 71/0054; A63B 21/0051; A63B 2071/0081; A63B 21/00069; A63B 2225/09; A63B 2225/093
See application file for complete search history.

(56) References Cited

U.S. PATENT DOCUMENTS 3,953,025 A * 4/1976 Mazman ..... A63B 23/0355 482/118
4,007,927 A * 2/1977 Proctor ..... A63B 22/0605 601/36
4,364,557 A * 12/1982 Serati ..... A63B 71/06 482/65
4,408,613 A * 10/1983 Relyea ..... A61B 5/222 482/901
4,417,724 A * 11/1983 Bikker ..... A63B 21/4049 188/251 A (Continued)

*Primary Examiner* — Garrett K Atkinson

(57) ABSTRACT

An electric treadmill includes a treadmill frame, an endless belt, a motor coupled to the endless belt for driving the endless belt to rotate, a brake device and a lifting device. The brake device has a rotating disc coaxially fixed to a motor shaft of the motor and a magnetic brake mechanism. The magnetic brake mechanism has at least one magnetic portion for applying a drag force against rotation of the rotating disc. The lifting device is operable to drive the magnetic brake mechanism to move between a first position where the magnetic portion is located close to the rotating disc and a second position where the magnetic portion is located away from the rotating disc. When there is no electric power supplied to the electric treadmill, the magnetic brake mechanism will automatically move to the first position due to gravity to stop rotation of the endless belt.

12 Claims, 10 Drawing Sheets

(56) References Cited

U.S. PATENT DOCUMENTS 4,595,198 A * 6/1986 Sparks ..... A63B 23/0482 482/119
4,673,177 A * 6/1987 Szymski ..... A63B 21/225 482/64
5,031,901 A * 7/1991 Saarinen ..... A63B 21/0051 310/78
5,466,203 A * 11/1995 Chen ..... A63B 21/0051 482/57
5,916,067 A * 6/1999 Morasse ..... A63B 69/16 482/61
6,491,606 B1 * 12/2002 Swift ..... A63B 22/0605 482/65
6,659,486 B2 * 12/2003 Eschenbach ..... B62K 3/002 280/62
6,761,667 B1 * 7/2004 Cutler ..... A63B 22/0023 482/54
7,172,532 B2 * 2/2007 Baker ..... A63B 22/0605 403/109.1
7,314,434 B2 * 1/2008 Chen ..... A63B 21/0051 188/164
7,364,533 B2 * 4/2008 Baker ..... A63B 22/0605 403/324
7,470,220 B2 * 12/2008 Hernandez ..... A63B 21/00069 280/288.4
8,585,561 B2 * 11/2013 Watt ..... A63B 21/0051 482/57
8,834,324 B2 * 9/2014 Lull ..... A63B 21/4045 482/65
8,876,668 B2 * 11/2014 Hendrickson ..... A63B 22/0023 482/54
9,044,635 B2 * 6/2015 Lull ..... A63B 23/0476
9,327,162 B2 * 5/2016 Huang ..... A63B 22/06
9,839,807 B2 * 12/2017 Golesh ..... A63B 21/015
9,919,182 B2 * 3/2018 Golesh ..... A63B 21/00069
10,112,067 B2 * 10/2018 Golesh ..... A63B 21/015
10,376,730 B2 * 8/2019 Cei ..... A63B 21/0052
11,311,772 B1 * 4/2022 Cooper ..... A63B 21/4035
2002/0013197 A1 * 1/2002 Tacx ..... A63B 69/16 482/61
2008/0234112 A1 * 9/2008 Hernandez ..... A63B 21/4049 188/24.14
2009/0137367 A1 * 5/2009 Hendrickson ..... A63B 21/0051 482/54
2010/0069205 A1 * 3/2010 Lee ..... A63B 21/0051 482/63
2010/0234185 A1 * 9/2010 Watt ..... A63B 22/0605 482/8
2010/0323850 A1 * 12/2010 Bingham, Jr. ..... A63B 21/225 403/409.1
2012/0088637 A1 * 4/2012 Lull ..... A63B 21/015 482/57
2012/0088638 A1 * 4/2012 Lull ..... A63B 21/00069 482/57
2016/0166877 A1 * 6/2016 Cei ..... A63B 22/0285 482/54
2016/0263417 A1 * 9/2016 Golesh ..... A63B 21/0051
2018/0200566 A1 * 7/2018 Weston ..... A63B 71/0622
2021/0154517 A1 * 5/2021 Petrillo ..... A63B 21/0056

* cited by examiner

MOTOR BRAKE DEVICE FOR EXERCISE APPARATUS

CROSS-REFERENCE TO RELATED APPLICATIONS

This is a continuation of application Ser. No. 17/537,493, filed Nov. 30, 2021.

FIELD OF THE INVENTION

The present invention relates to an electric treadmill. More particularly, the present invention relates to a motor brake device of the electric treadmill.

DESCRIPTION OF THE RELATED ART

Treadmills are common exercise apparatuses for fitness. Referring to FIG. 1, a conventional treadmill 10 include a motor 11, a front roller 12, a rear roller 13 and a treadmill belt 14 mounted around the front roller 12 and a rear roller 13. The motor 11 is configured to drive the front roller 12 to rotate the treadmill belt 14, so that a user is able to perform exercises of walking, jogging or running on the treadmill belt 14. The rotational speed of the treadmill belt 14 is controlled by the motor 11. Therefore, the faster the rotational speed of the motor 11, the faster the rotational speed of the treadmill belt 14.

In General, the conventional treadmill 10 must use electric power from an external power source to drive a motor 11 to run, thereby driving the treadmill belt 14 to rotate circularly for allowing a user to exercise thereon. When the external power is interrupted (e.g. power outage or blackout), or the treadmill 10 is not plugged in, or the power switch of the treadmill 10 is not turned on, the treadmill 10 does not receive any electrical power. Without electrical power, the motor 11 cannot control or restrain the treadmill belt 14, and the treadmill belt 14 may be rotated due to an external force, especially for slat-belt treadmills. When the treadmill 10 is not receiving power, if a user does not notice it and directly steps on the treadmill 10, the user's feet may push the top surface of the treadmill belt 14 to slide forward or backward, causing the user to lose their balance or fall.

The present invention has arisen to mitigate and/or obviate the disadvantages of the conventional method. Further benefits and advantages of the present invention will become apparent after a careful reading of the detailed description with appropriate reference to the accompanying drawings.

SUMMARY OF THE INVENTION

The present invention is directed to an electric treadmill. When there is no electric power supplied to the electric treadmill to drive the motor, it will automatically stop rotation of the endless belt to avoid unexpected movement of the endless belt when a user steps on the belt.

According to one aspect of the present invention, an electric treadmill comprises a treadmill frame, an endless belt mounted around the treadmill frame, a motor coupled to the endless belt for driving the endless belt to rotate, a brake device, and a lifting device. The brake device has a rotating disc coaxially fixed to a motor shaft of the motor and a magnetic brake mechanism being movable relative to the rotating disc. The magnetic brake mechanism has at least one magnetic portion for applying a drag force against rotation of the rotating disc. The lifting device is mounted on the motor and coupled to the magnetic brake mechanism for driving the magnetic brake mechanism to move between a first position where the magnetic portion is located close to the rotating disc and a second position where the magnetic portion is located away from the rotating disc. When the magnetic brake mechanism is located in the first position, a magnetic field created by the magnetic portion will pass through the rotating disc to generate the drag force against rotation of the rotating disc due to eddy currents induced in the rotating disc so as to stop rotation of the endless belt. Specifically, when there is no electric power supplied to the electric treadmill, the magnetic brake mechanism will automatically move to the first position to stop rotation of the endless belt.

Preferably, when there is no electric power supplied to the electric treadmill, the magnetic brake mechanism will move downward to the first position to stop rotation of the rotating disc due to potential difference between the second position and the first position so as to stop rotation of the motor shaft and the endless belt.

Preferably, the lifting device has a driving unit and a connecting member, the driving unit configured to drive the connecting member to move with respect to the rotating disc, the magnetic brake mechanism mounted on the connecting member so that the driving unit is operable to drive the magnetic brake mechanism to move between the first position and the second position through the connecting member. Moreover, the lifting device has a supporting plate fixed on the motor for supporting the driving unit and the connecting member. The connecting member is pivotally mounted on the supporting plate and driven by the driving unit to move the magnetic brake mechanism to the first position or the second position with respect to the rotating disc.

Preferably, the connecting member has a guide slot and the supporting plate of the lifting device has a positioning post passing through the guide slot, so that the positioning post is movable within the guide slot for guiding the movement of the magnetic brake mechanism between the first positon and the second position.

Preferably, the driving unit has a step motor and a gear member and the connecting member has a gear rack coupled to the gear member, the step motor configured to drive the gear member, the gear member and the gear rack being engaged with each other, so that the step motor is operable to drive the gear member to drive the gear rack to move the connecting member with respect to the rotating disc.

Preferably, the lifting device further has two position sensors spaced apart in a distance, one of the two position sensors configured to detect whether the magnetic brake mechanism reaches the first position and the other one of the two position sensors configured to detect whether the magnetic brake mechanism reaches the second position. For example, the two position sensors are limit switches. When a trigger member touches one of the two limit switches, the magnetic brake mechanism is stopped at the first position or the second position.

Preferably, the magnetic brake mechanism has a bracket and at least two magnets mounted on an inner surface of the bracket. When the magnetic brake mechanism is located in the first position, the least two magnets are disposed on opposite sides of the rotating disc to provide the drag force thereto. When the magnetic brake mechanism is located in the second position, the least two magnets are away from the rotating disc.

Preferably, a height of a gravity center of the magnetic brake mechanism at the second position is higher than the height the gravity center of the magnetic brake mechanism at the first position, so that when there is no electric power supplied to the electric treadmill, the magnetic brake mechanism will move downward to the first position due to its weight so as to stop rotation of the endless belt.

Further benefits and advantages of the present invention will become apparent after a careful reading of the detailed description with appropriate reference to the accompanying drawings.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
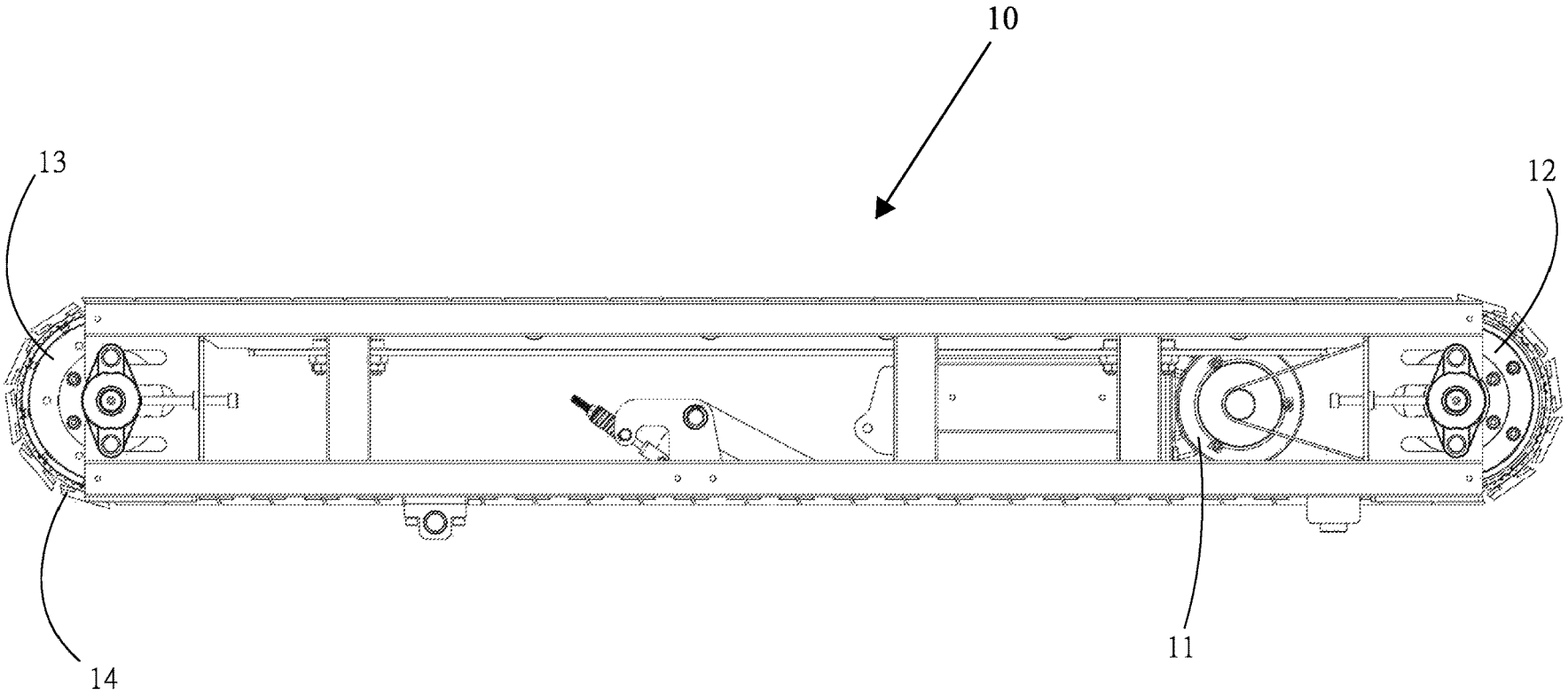
FIG. 1 (Prior Art)
FIG. 1 is a side view of a conventional electric treadmill, briefly showing the treadmill platform of the conventional electric treadmill.
Figure 2:
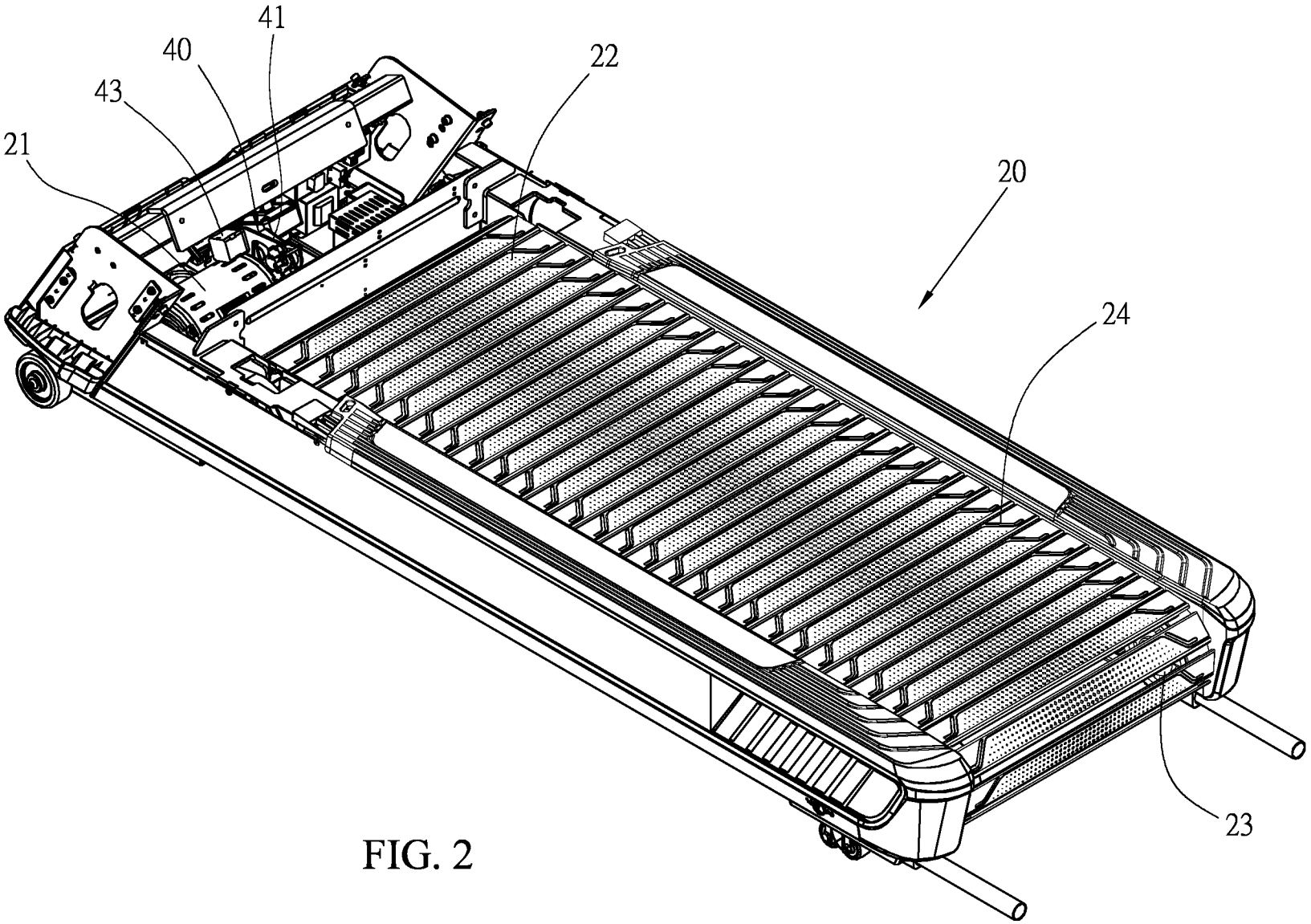
FIG. 2 is a perspective view of an electric treadmill in accordance with a preferred embodiment of the present invention, wherein the electric treadmill briefly shows the treadmill platform.
Figure 3:
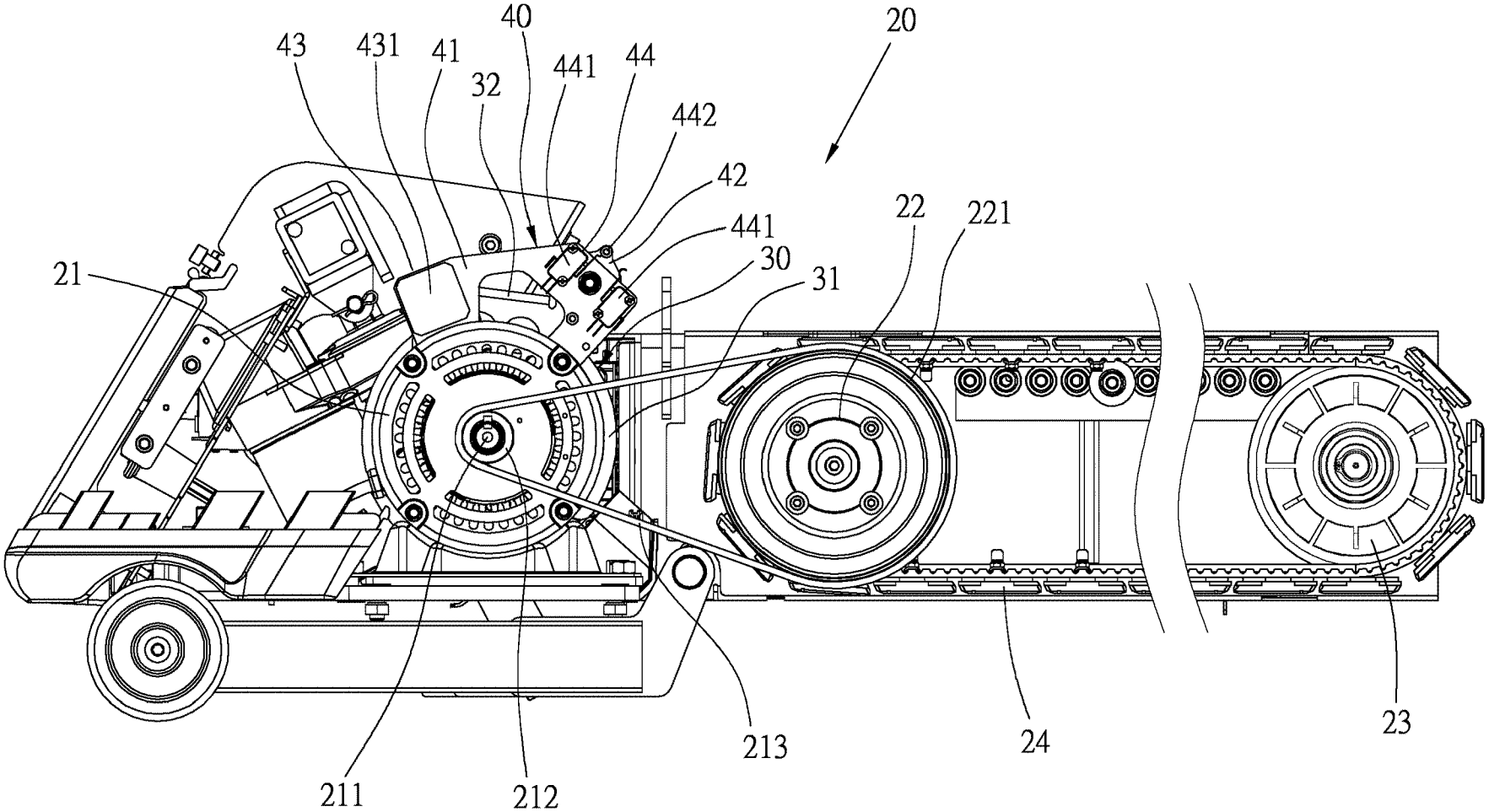
FIG. 3 is a side view of the electric treadmill for showing the brake device.

Referring to FIG. 2 and FIG. 3, an electric treadmill 20 is illustrated in accordance with a preferred embodiment of the present invention. The treadmill 20 includes a motor 21, a front roller 22, a rear roller 23 and an endless belt 24. FIG. 2 only briefly shows the treadmill platform of the treadmill 20. The treadmill 20 has a treadmill frame, the front roller 22 is rotatably mounted on the front end of the treadmill frame, and the rear roller 23 is rotatably mounted on the rear end of the treadmill frame. The endless belt 24 is mounted around the front roller 22 and the rear roller 23, such that the endless belt 24 can be circularly revolved around the treadmill frame for allowing a user to walk or run thereon. In the preferred embodiment, the endless belt 24 may be a slat belt. The motor 21 is mounted on the front end of the treadmill frame and coupled to the front roller 22 for driving the endless belt 24 to rotate with respect to the treadmill frame of the treadmill 20. The motor 21 has a motor shaft 211. The motor 21 is coupled to the front roller 22 through first and second pulleys 212, 221 and a driving belt 213. The first pulley 212 is mounted on the motor shaft 211 of the motor 21. The second pulley 221 is mounted on the front roller 22. The driving belt 213 is mounted around the two pulleys 212, 221, so that the front roller 22 can be driven by the motor 21 through the driving belt 213. When the motor shaft 211 of the motor 21 rotates, the driving belt 213 will drive the second pulley 221 to rotate the front roller 22, and the rotation of the front roller 22 will drive the endless belt 24 to rotate, and the rear roller 23 will also be driven by the endless belt 24. Thus the rotation of the endless belt 24 is provided for allowing the user to perform exercises of walking, jogging or running thereon.

Referring to FIG. 3 to FIG. 6, the treadmill 20 further has a brake device 30 configured to stop rotation of the motor 21. The brake device 30 has a rotating disc 31 (or a conductive disc) and a magnetic brake mechanism 32. The rotating disc 31 is an electrical conductor such as a metal disc. The rotating disc 31 is coaxially fixed on the outer end of the motor shaft 211 of the motor 21, such that the rotating disc 31 is rotatable with respect to an axis of the motor shaft 211. In the preferred embodiment of the present invention, the rotating disc 31 and the first pulley 212 are respectively positioned at opposite sides of the motor shaft 211, namely located at opposite sides of the motor 21. In another embodiment, the rotating disc 31 and the first pulley 212 may be positioned on the same side. When the motor shaft 211 rotates, the rotating disc 31 will rotate with it.

Figure 4:
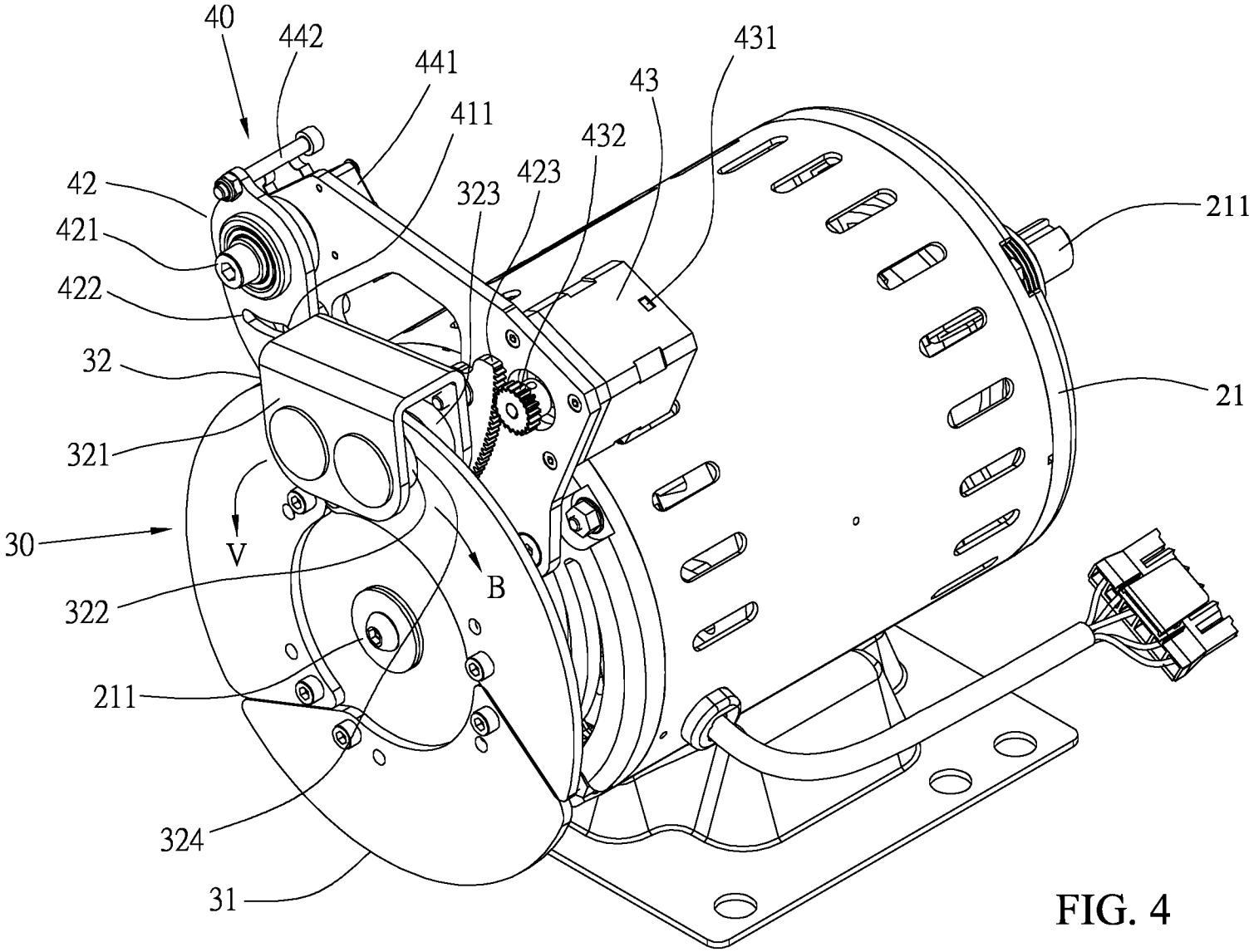
FIG. 4 is a perspective view showing the motor, the brake device and the lifting device of the electric treadmill shown in FIG. 2.
Figure 5:
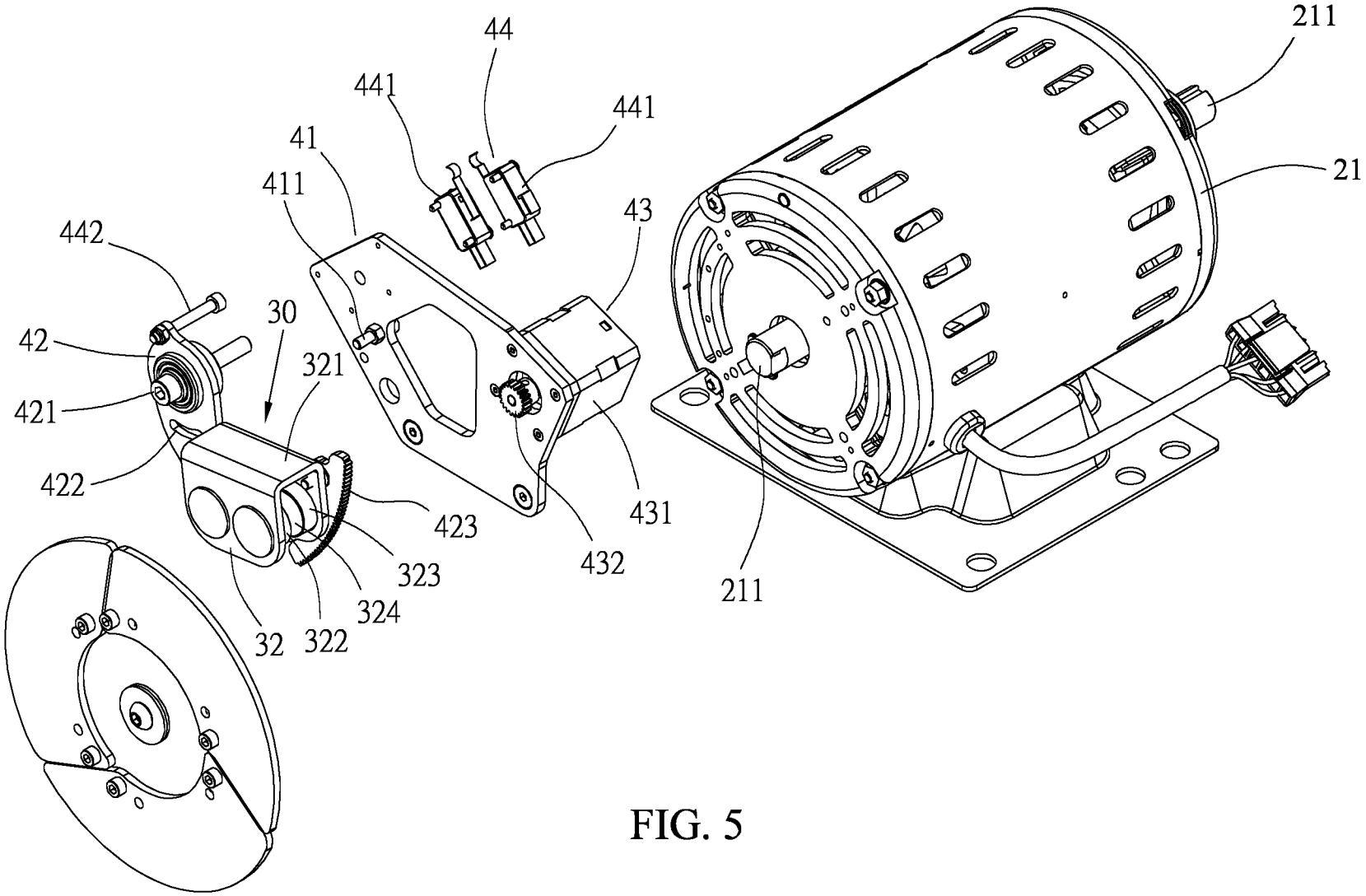
FIG. 5 is a perspective exploded view of FIG. 4.
Figure 7:
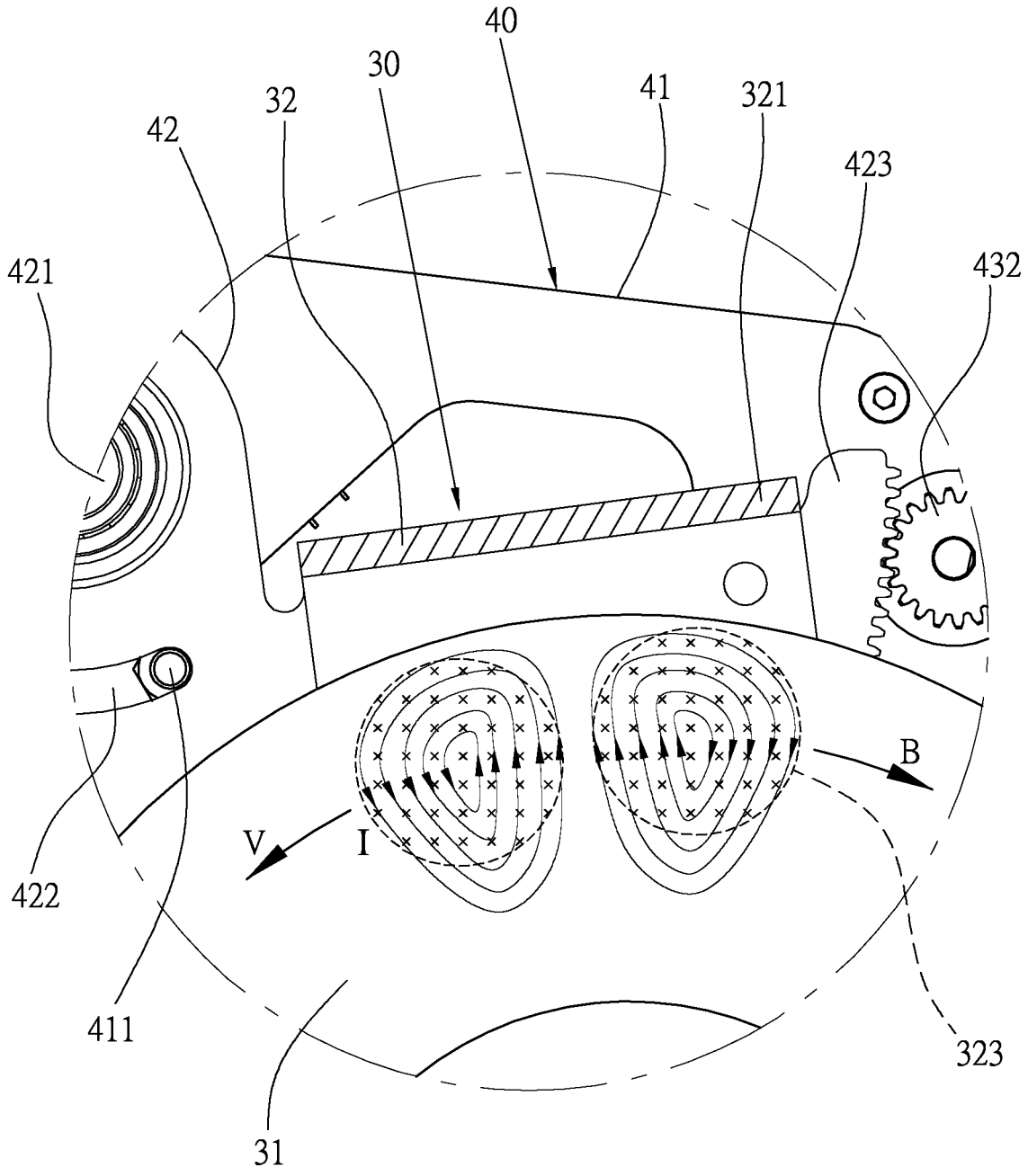
FIG. 7 illustrates that an eddy current is induced in the rotating disc.

Referring to FIG. 4 and FIG. 5, the magnetic brake mechanism 32 has a bracket 321. The bracket 321 has two parallel side walls. In the preferred embodiment, the magnetic brake mechanism 32 has one or more first magnetic portions 322 and one or more second magnetic portions 323 respectively disposed on the inner sides of the two side walls of the bracket 321. Each first magnetic portion 322 is located opposite to the corresponding second magnetic portion 323 to form a pair of magnetic portions. For example, two magnets may be disposed at opposite sides of the bracket 321 to form the first magnetic portion 322 and the second magnetic portion 323. The magnetism of the first magnetic portion 322 and the second magnetic portion 323 are opposite, namely one is a north pole and the other is a south pole. In another embodiment, the magnetic brake mechanism may have one or more magnetic portions disposed at one side of the bracket only. As shown in FIG. 4, there are two first magnetic portions 322 and two second magnetic portions 323 respectively disposed at two sides of the bracket 321, but only a single first magnetic portion and a single second magnetic portion will be described hereinafter. Referring to FIG. 4 and FIG. 5, the first magnetic portion 322 and the second magnetic portion 323 are spaced apart in a distance, namely a space 324 defined therebetween. The space 324 is greater than the thickness of the rotating disc 31. Referring to FIG. 7, when the rotating disc 31 rotates with the motor shaft 211 of the motor 21 and moves through the space 324, the magnetic field created by the first and second magnetic portions 322, 323 will pass through the rotating disc 31, causing an eddy current to be induced in the rotating disc 31 for resisting rotation of the rotating disc 31 by eddy current braking effect, so that rotation of the motor shaft 211 of the motor 21 can be restricted or stopped. As illustrated in FIG. 7, the indicia "V" represents the rotation direction of the rotating disc 31, the indicia "I" represents the direction of the eddy current and the indicia "B" represents the direction of the drag force on the rotating disc 31 which opposes motion of the rotating disc 31.

Figure 8:
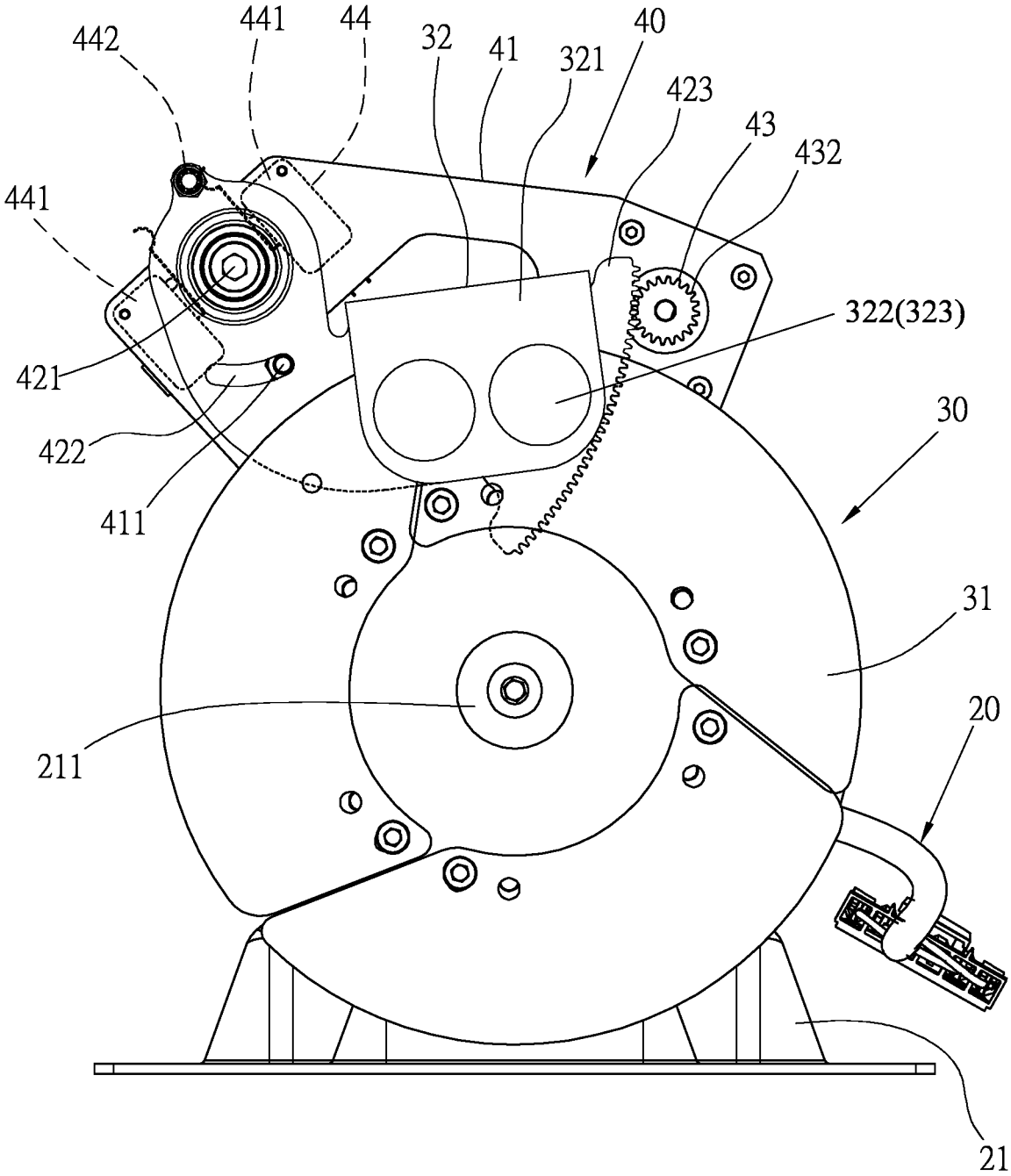
FIG. 8 illustrates that the magnetic brake mechanism is located at a close position.
Figure 9:
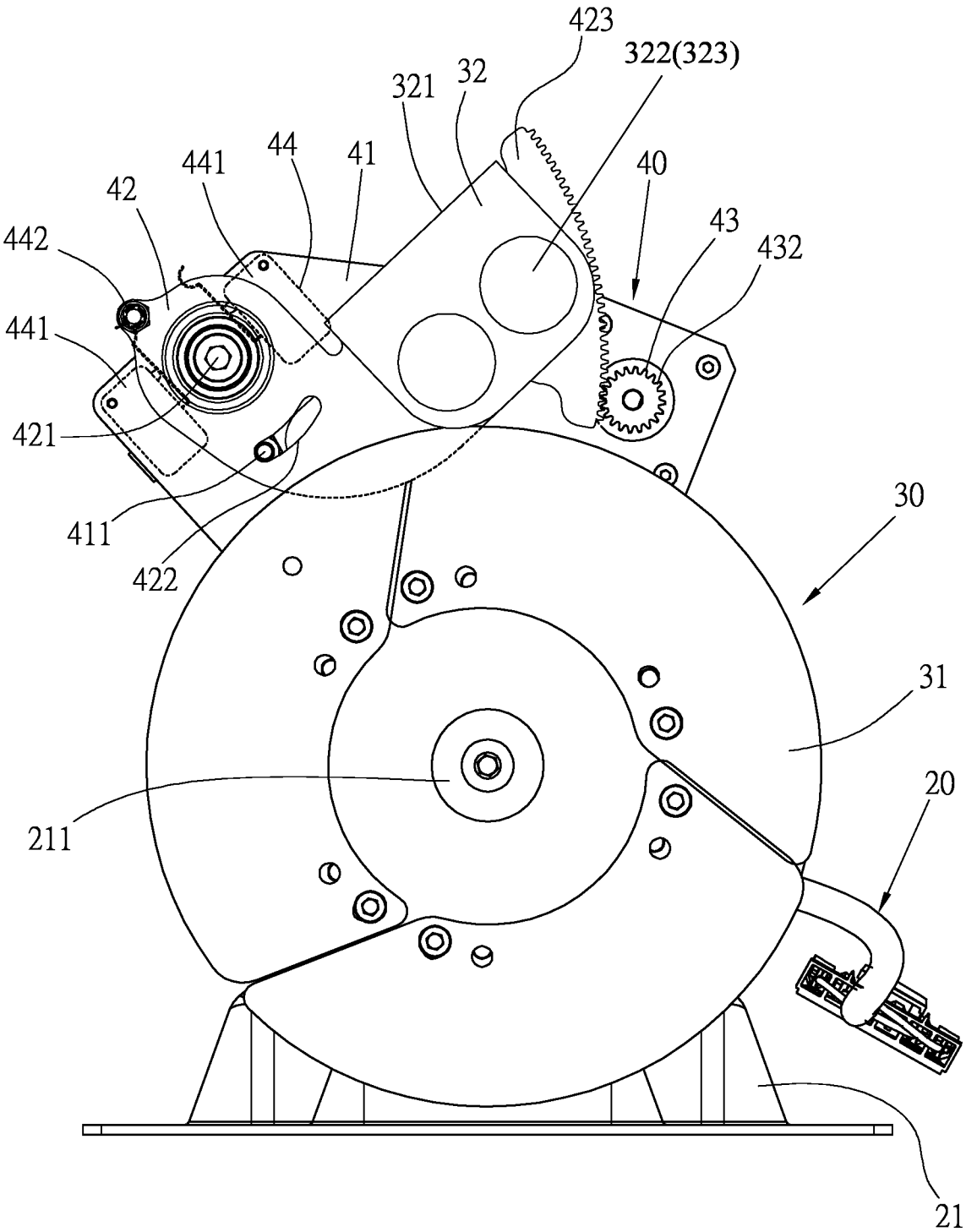
FIG. 9 illustrates that the magnetic brake mechanism is located at a distant position.

Referring to FIG. 3 and FIG. 4, a lifting device 40 is mounted on the motor 21. In the preferred embodiment, the lifting device 30 is arranged close to the rotating disc 31, but it is not limited thereto. The lifting device 30 is configured to drive the magnetic brake mechanism 32 to move between a close position where the magnetic portions 322, 323 are located close to the rotating disc 31 (as shown in FIG. 8) and a distant position where the magnetic portions 322, 323 are located away from the rotating disc 31 (as shown in FIG. 9). The lifting device 40 has a supporting plate 41, a connecting member 42, a driving unit 43 and a sensing device 44. The supporting plate 41 is fixed on the motor 21 for supporting the lifting device 40. Generally, the lifting device 40 is located on a top portion of the motor 21.

As shown in FIG. 4, the connecting member 42 has one end pivotally connected to a pivot 421 which is secured on the supporting plate 41, such that the other end (or free end) of the connecting member 42 is rotatable about the pivot 421. In another embodiment, the pivot 421 may be directly secured on the motor 21 or other fixed position; or the pivot 421 may be formed on one end of the connecting member 42, such that the connecting member 42 can be pivotally mounted on the supporting plate 41 via the pivot 421. Referring to FIG. 5, the supporting plate 41 has a positioning post 411 protruded therefrom, and the connecting member 42 has a guide slot 422 corresponding to the positioning post 411. The positioning post 411 can pass through the guide slot 422 and the positioning post 411 is limited to be movable within the guide slot 422, so as to limit the maximum swing angle of the connecting member 42. In the preferred embodiment, the connecting member 42 has a gear rack 423 disposed at its free end. The bracket 321 of the magnetic brake mechanism 32 is mounted on the connecting member 42, so that the magnetic brake mechanism 32 can be movable with the connecting member 42 between a close position close to the rotating disc 31 and a distant position away from the rotating disc 31, so that the magnetic brake mechanism 32 can be close to or far away from the rotating disc 31. In the preferred embodiment, the gravity center position of the magnetic brake mechanism 32 at the distant position is higher than the gravity center position of the magnetic brake mechanism 32 at the close position, so that the magnetic brake mechanism 32 tends to move toward the close position due to potential difference between the two positions. The driving unit 43 is operable to drive the magnetic brake mechanism 32 to move between the close position and the distant position through the connecting member 42. The driving unit 43 includes a step motor 431 and a gear member 432. The step motor 431 is fixed on the supporting plate 41 and configured for driving the gear member 432. The gear member 432 and the gear rack 423 are engaged with each other. The step motor 431 can be powered to drive the gear member 432 to rotate in forward and reverse directions so as to drive the gear rack 423 to rise and fall, and therefore the magnetic brake mechanism 32 can be controlled to move to the distant position or the close position for adjusting the distance between the rotating disc 31 and the magnetic brake mechanism 32.

Figure 6:
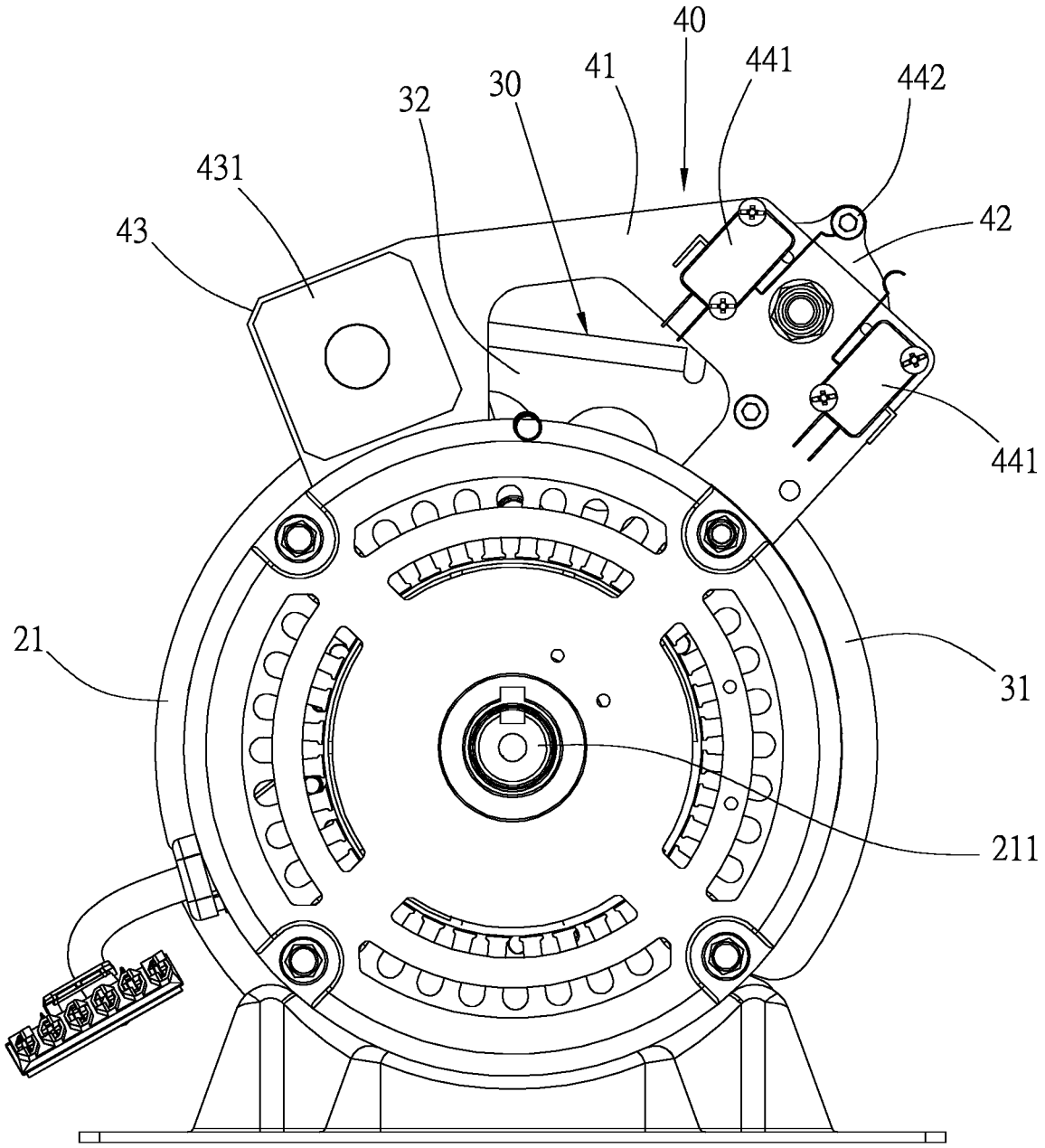
FIG. 6 is a side view of FIG. 4 for showing the sensing device.

Referring to FIG. 5 and FIG. 6, the sensing device 44 has two position sensors 441 and a trigger member 442. In the preferred embodiment, the two position sensors 441 are limit switches for detecting whether the connecting member 42 moves to the predetermined positions. The two position sensors 441 are fixed on the supporting plate 41 and spaced apart in a distance. The trigger member 442 is mounted on the connecting member 42 and moved with rotation of the connecting member 42. When the trigger member 442 touches one of the two position sensors 441, it means that the magnetic brake mechanism 32 has reached the close position or the distant position, and the driving unit 43 is controlled to stop rotation of the step motor 431.

As shown in FIG. 3 and referring to FIG. 9, when the motor 21 of the treadmill 20 is powered in an operation state, the motor shaft 211 of the motor 21 has no need to be stopped, so that the step motor 431 of the driving unit 43 is operated to rotate the gear member 432 clockwise to drive the gear rack 423 of the connecting member 42 to move upward. Therefore, the connecting member 42 can be rotated upward in a counterclockwise direction about the pivot 421, so that the magnetic brake mechanism 32 on the connecting member 42 is relatively lifted away from the rotating disc 31 to the distant position. When the trigger member 442 touches the lower position sensor 441 (namely the lower limit switch), the step motor 431 will stop rotating, so that the connecting member 42 is maintained at the same position, as shown in FIG. 9. After the magnetic brake mechanism 32 is far away from the rotating disc 31, when the motor 21 drives the motor shaft 211 to rotate, the rotating disc 31 can also rotate freely. At the same time, the motor 21 can also drive the first pulley 212 to drive the driving belt 213 and the second pulley 221 to rotate, so that the endless belt 24 can be driven by the front roller 22 to rotate.

Referring to FIG. 8, when the motor 21 of the treadmill is not running, the step motor 431 of the driving unit 43 will drive the gear member 432 to rotate in a counterclockwise direction. The counterclockwise rotation of the gear member 432 drives the gear rack 423 of the connecting member 42 to move downward, so that the connecting member 42 can be rotated downward in a clockwise direction about the pivot 421, and the magnetic brake mechanism 32 on the connecting member 42 is moved downward to close the rotating disc 31 to the close position. When the trigger member 442 touches the upper position sensor 441 (namely the upper limit switch), the step motor 431 will stop rotating, so that the connecting member 42 is maintained at the same position, as shown in FIG. 8. When the magnetic brake mechanism 32 is located close to the rotating disc 31, the rotating disc 31 will be received in the space 324 and the magnetic field between the first magnetic portions 322 and the second magnetic portions 323 will pass through the rotating disc 31. Therefore, when the rotating disc 31 rotates, an eddy current will be induced in the rotating disc 31 between the first magnetic portion 322 and the second magnetic portion 323, as shown in FIG. 7. The two magnetic portions 322, 323 exert a drag force on the rotating disc 31 which opposes its motion due to eddy current braking effect, so that the motor 21 can be maintained in a static state to prevent the endless belt 24 from rotating due to external force.

It should be noted that, rotation of the connecting member 42 is restricted within a predetermined range due to the positioning post 411 and the guide slot 422 so as to prevent the connecting member 42 from exceeding predetermined rotation positions, namely exceeding the aforementioned close position and the distant position. Specifically, if the treadmill 20 suddenly loses electric power, neither the motor 21 nor the step motor 431 can function at that time. Therefore, the step motor 431 cannot hold the gear rack 423 of the connecting member 42 anymore, such that the free end of the connecting member 42 will fall by gravity, namely the connecting member 42 will rotate clockwise about the pivot 421 freely, and the magnetic brake mechanism 32 will move downward toward the rotating disc 31 due to its weight, namely moving to the close position. Under this arrangement, even in the state of power outage, the magnetic brake mechanism 32 can still move to the close position to stop rotation of the rotating disc 31 by the aforementioned braking effect.

Figure 10:
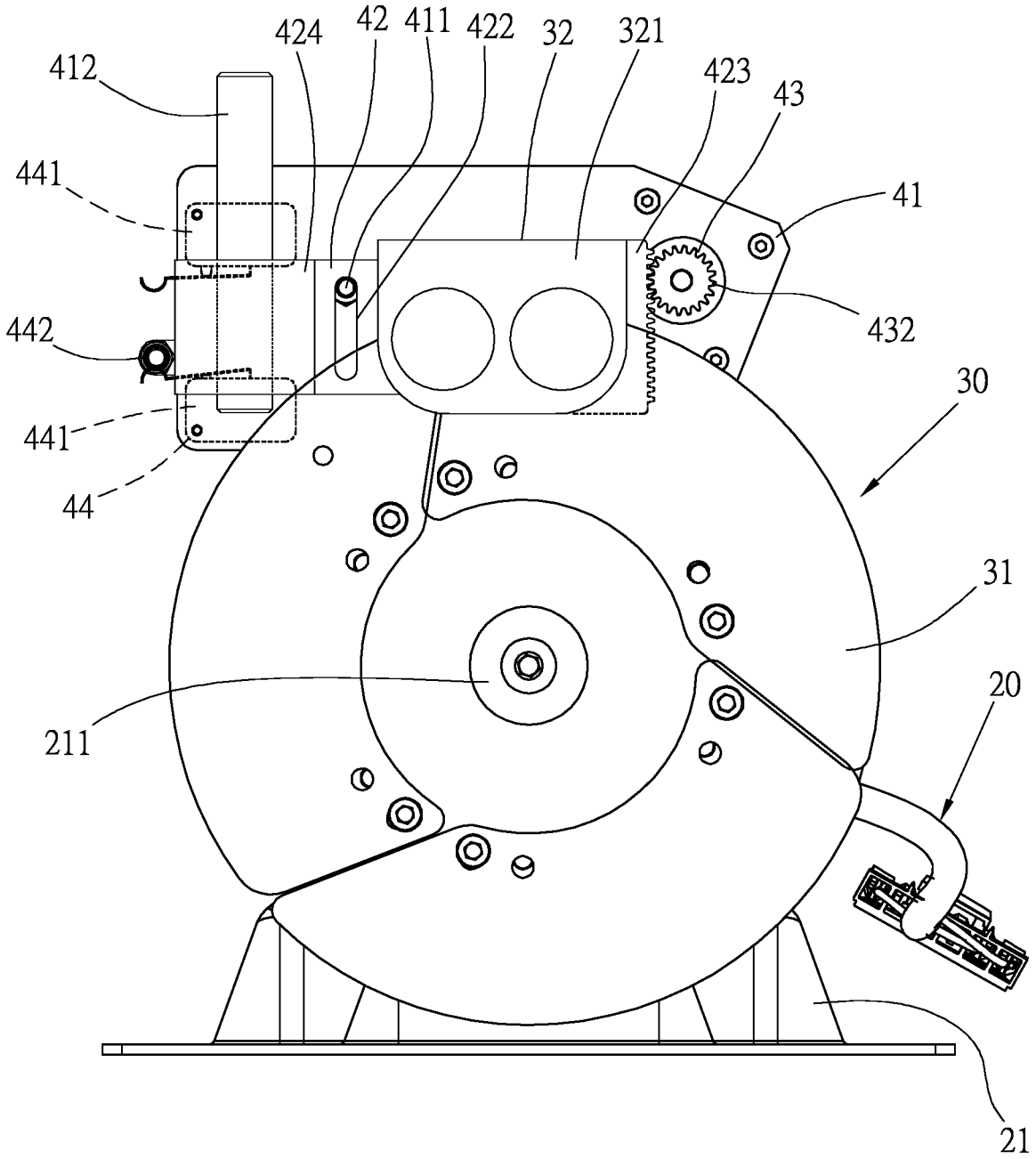
FIG. 10 illustrates another preferred embodiment of the present invention.

FIG. 10 illustrates another preferred embodiment of the present invention, which is similar to the aforementioned embodiment, except that the lifting device 40 has a sliding rod 412 mounted on the supporting plate 41 vertically and the connecting member 42 has a sliding seat 424 slidably mounted on the sliding rod 412, so that the connecting member 42 can be moved vertically with respect to the sliding rod 412. For example, the connecting member 42 can be controlled to move upward to the distant position or move downward to the close position. In this embodiment, the two position sensors 441 are disposed vertically on the supporting plate 41 for detecting whether the connecting member 42 moves to the predetermined positions, namely the close position or the distant position. The magnetic brake mechanism 32 can be moved vertically with the connecting member 42 between the close position and the distant position.

Moreover, the position of the magnetic brake mechanism 32 may be adjusted by the driving unit 43. When the magnetic brake mechanism 32 gradually moves away from the rotating disc 31 toward the distant position, the braking force applied to the rotating disc 31 will be decreased since the generated eddy current is decreased. In contrast, when the magnetic brake mechanism 32 gradually moves close to the rotating disc 31 toward the close position, the braking force applied to the rotating disc 31 will be increased since the generated eddy current is increased. Therefore, rotational speed of the endless belt 24 or the resistance against rotation of the endless belt 24 can be adjusted by adjusting position of the magnetic brake mechanism 32 relative to the rotating disc 31. In addition, when the rotational speed of the motor 21 exceeds the preset setting value, the magnetic brake mechanism 32 can also be used to generate eddy current braking effect to reduce rotational speed of the motor 21.

The brake device of the present invention uses the magnetic brake mechanism to generate an eddy current braking effect on the rotating disc, so that the motor can have a passive braking effect when the motor is in a resting state. In contrast to the conventional motor that still keeps rotatable in the resting state, the brake device of the present invention can generate a braking effect on the motor to stop rotation of the treadmill belt when the motor is in the resting state for preventing the treadmill belt from rotating due to any external force.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. An electric treadmill, comprising:

a treadmill frame;

an endless belt mounted around the treadmill frame;

a motor coupled to the endless belt for driving the endless belt to rotate;

a brake device having a rotating disc coaxially fixed to a motor shaft of the motor and a magnetic brake mechanism being movable relative to the rotating disc, the magnetic brake mechanism having at least one magnetic portion for applying a drag force against rotation of the rotating disc; and a lifting device mounted on the motor and coupled to the magnetic brake mechanism for driving the magnetic brake mechanism to move between a first position where the magnetic portion is located close to the rotating disc and a second position where the magnetic portion is located away from the rotating disc;

wherein when the magnetic brake mechanism is located in the first position, a magnetic field created by the magnetic portion will pass through the rotating disc to generate the drag force against rotation of the rotating disc due to eddy currents induced in the rotating disc so as to stop rotation of the endless belt; and wherein when there is no electric power supplied to the electric treadmill, the magnetic brake mechanism will automatically move to the first position to stop rotation of the endless belt.

2. The electric treadmill as claimed in claim 1, wherein when there is no electric power supplied to the electric treadmill, the magnetic brake mechanism will move downward to the first position to stop rotation of the rotating disc due to potential difference between the second position and the first position so as to stop rotation of the motor shaft and the endless belt.

3. The electric treadmill as claimed in claim 1, wherein the lifting device has a driving unit and a connecting member, the driving unit configured to drive the connecting member to move with respect to the rotating disc, the magnetic brake mechanism mounted on the connecting member so that the driving unit is operable to drive the magnetic brake mechanism to move between the first position and the second position through the connecting member.

4. The electric treadmill as claimed in claim 3, wherein the lifting device has a supporting plate fixed on the motor for supporting the driving unit and the connecting member, the connecting member being pivotally mounted on the supporting plate and being driven by the driving unit to move the magnetic brake mechanism to the first position or the second position with respect to the rotating disc.

5. The electric treadmill as claimed in claim 4, wherein the connecting member has a guide slot and the supporting plate of the lifting device has a positioning post passing through the guide slot, so that the positioning post is movable within the guide slot for guiding the movement of the magnetic brake mechanism between the first positon and the second position.

6. The electric treadmill as claimed in claim 4, wherein the lifting device has two limit switches and a trigger member, the two limit switches fixed on the supporting plate and being spaced apart in a distance, the trigger member being mounted on the connecting member and being movable with movement of the connecting member between the two limit switches; and wherein when the trigger member touches one of the two limit switches, the magnetic brake mechanism is stopped at the first position or the second position.

7. The electric treadmill as claimed in claim 3, wherein the driving unit has a step motor and a gear member and the connecting member has a gear rack coupled to the gear member, the step motor configured to drive the gear member, the gear member and the gear rack being engaged with each other, so that the step motor is operable to drive the gear member to drive the gear rack to move the connecting member with respect to the rotating disc.

8. The electric treadmill as claimed in claim 3, wherein the lifting device has two limit switches and a trigger member, the two limit switches being spaced apart in a distance, the trigger member being disposed on the connecting member and being movable with movement of the connecting member between the two limit switches; and wherein when the trigger member touches one of the two limit switches, the magnetic brake mechanism is stopped at the first position or the second position.

9. The electric treadmill as claimed in claim 1, wherein the lifting device further has two position sensors spaced apart in a distance, one of the two position sensors configured to detect whether the magnetic brake mechanism reaches the first position and the other one of the two position sensors configured to detect whether the magnetic brake mechanism reaches the second position.

10. The electric treadmill as claimed in claim 1, wherein the magnetic brake mechanism has a bracket and at least two magnets mounted on an inner surface of the bracket; when the magnetic brake mechanism is located in the first position, the least two magnets are disposed on opposite sides of the rotating disc to provide the drag force thereto; and when the magnetic brake mechanism is located in the second position, the least two magnets are away from the rotating disc.

11. The electric treadmill as claimed in claim 1, wherein the magnetic brake mechanism has a bracket and at least one pair of magnets, the bracket having two parallel side walls, the least one pair of magnets defining a first magnetic portion and a second magnetic portion respectively disposed on inner sides of the two side walls of the bracket, the first magnetic portion and the second magnetic portion being spaced apart in a distance and opposite to each other; and wherein when the magnetic brake mechanism moves to the first position, the rotating disc is located in between the first magnetic portion and the second magnetic portion.

12. The electric treadmill as claimed in claim 1, wherein a height of a gravity center of the magnetic brake mechanism at the second position is higher than the height the gravity center of the magnetic brake mechanism at the first position, so that when there is no electric power supplied to the electric treadmill, the magnetic brake mechanism will move downward to the first position due to its weight so as to stop rotation of the endless belt.

* * * * *